United States Patent [19]

Cross, Jr.

[11] 4,318,427

[45] Mar. 9, 1982

[54] THERMAL INSULATION SYSTEM

[76] Inventor: Roger H. Cross, Jr., 927 Erie Station Rd., Rush, N.Y. 14543

[21] Appl. No.: 202,702

[22] Filed: Oct. 31, 1980

[51] Int. Cl.[3] ..... B32B 1/08; D03D 49/26

[52] U.S. Cl. ..... 138/149; 428/36; 428/76; 428/188; 428/920

[58] Field of Search ..... 428/70, 76, 188, 36, 428/920, 921; 206/542; 138/32, 34, 113, 149; 220/DIG. 9, 415

[56] References Cited

U.S. PATENT DOCUMENTS 3,486,563 12/1969 Cholin et al. ..... 428/920

OTHER PUBLICATIONS

*Hackh's Chemical Dictionary,* McGraw-Hill, 1969, Fourth Edition, p. 710.

*Primary Examiner*—Paul J. Thibodeau

*Attorney, Agent, or Firm*—Stonebraker, Shepard & Stephens

[57] ABSTRACT

Particulate insulation materials such as vermiculite, perlite, or cellulose are packaged in sturdy resinous bags 10 sealed at each end and then positioned directly over a body to be insulated. The resin bags contain the insulation particles, hold them in place, and keep them dry; and the particles can be spread into an even barrier layer within the bags, which protect the particles during use. Bags 10 can be laid side by side over a surface, above and below a pipe, and concentrically surrounding a pipe. Bagged insulation particles are especially suitable for underground insulation where backfilled earth applies uniform pressure helping to hold the bags and insulation particles in place indefinitely.

2 Claims, 7 Drawing Figures

THERMAL INSULATION SYSTEM

BACKGROUND

Although some particulate insulation materials have excellent insulation capacity and are relatively inexpensive, they are also flowable so their use is limited to situations where they can be easily held in place and survive without deterioration. Because of this, many insulation jobs require more expensive structural materials or containment systems.

I have discovered an economical and practical way of extending the usefulness of particulate insulation materials to take advantage of their low cost compared to alternative materials. My invention makes particulate insulation materials especially attractive for underground insulation, but is not limited to this.

SUMMARY

I have discovered that particulate insulation materials such as vermiculite, perlite, and cellulose can be packaged and sealed within tough, tubular, resinous bags and used without being removed from the bags. The insulation material can be arranged in an even thermal barrier within the bags that package it, and the bags can contain and protect the insulation during use. There are several ways the bags can be placed side by side or end to end to insulate different shaped bodies that can include tanks, pipes, and underground structures.

DRAWINGS

DETAILED DESCRIPTION

My invention takes advantage of the high R value and low cost of some particulate insulation materials. These presently include vermiculite, perlite, and cellulose, although other materials such as shredded or small sized resinous or fibrous materials may also qualify. These materials are generally flowable, and can gradually settle down in response to gravity and vibration so they are limited to use within structural containment systems.

I have found that packing and sealing these particulate insulation materials in tough, resinous bags can extend their use to new circumstances and take advantage of their low cost. Tubular resinous bags are readily available in different dimensions and different thicknesses and types of resin material from existing bag-making machines, and bags of suitable dimensions can be elongated to different lengths to fit different insulation jobs. Resinous bags can be initially sealed at one end in the conventional way and later sealed at the other end after being filled with a suitable quantity of insulation particles.

The insulation particles can be moved about within the bag without opening up the bag so that the insulation can be spread in an even thickness forming a uniform thermal barrier. A slack fill of insulation particles within a long tubular bag allows the insulation to be spread in an even layer nearly as wide as the full width of the bag, and bags can be laid side by side over a surface to be insulated. Keeping the long axis of the bags approximately horizontal prevents flow within the bag and keeps the insulation material in place. The bags form a tough and secure container keeping the insulation particles sealed within, and the bags also form a vapor barrier keeping the insulation dry and effective.

Figure 1:
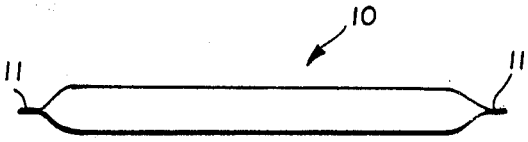
FIG. 1 is a side elevational view of a resinous bag containing particulate insulation arranged in an even thermal barrier according to my invention.
Figure 2:
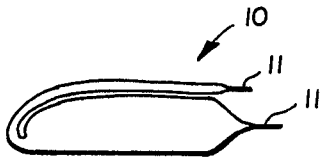
FIG. 2 is a side elevational view of a resinous bag that is slack filled with particulate insulation material and folded for compact shipping.

Resinous bags make good shipping containers for insulation particles, and being able to use the insulation without removing it from the bag simplifies installation. Hazardous dust is confined to the factory where the bags are filled, and the user merely positions the bags around a body to be insulated. A slack-filled bag 10 as shown in FIG. 1 with seals 11 at both ends can form an insulation layer of suitable depth for as wide as the dimensions of bag 10 allow, once the bag is laid in place and the insulation material distributed evenly within the bag. For compact and convenient shipping, the insulation particles within bag 10 can be moved to one end so that bag 10 can be folded back on itself as shown in FIG. 2.

Figure 3:
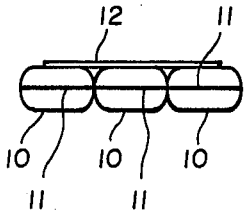
FIG. 3 is an end elevational view of several insulation bags arranged side by side to insulate the surface of a body.
Figure 4:
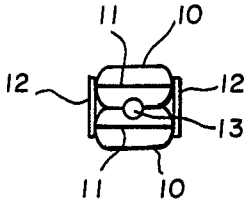
FIG. 4 is an end elevational view of upper and lower insulation bags arranged to insulate a pipe.

Bags of insulation particles can be laid side by side in contact with each other to cover the surface of a body to be insulated, and their ability to bend and conform to curved shapes makes them suitable for insulating many structures. A covering material 12 can be laid over juxtaposed bags 10 as shown in FIG. 3 or a sheath or wrapper can be applied to help hold bags 10 and the insulation they contain securely in place. Straps, adhesive tape, or covering sheets can also be used to hold the bags closely adjacent each other and reduce thermal leakage at the junctions between bags.

An underground pipe 13 can be readily insulated with long bags 10 filled with insulation particles. A lower bag 10 laid in the trench below pipe 13 affords an insulating bed on which pipe 13 can be laid, and an upper bag 10 laid on top of the pipe can complete the job. Pressure from the surrounding earth backfilled into the pipe trench holds bags 10 securely in place and keeps the insulation material they contain from shifting about so that pipe 13 remains well insulated. Bags 10 with their end seals 11 also keep the insulation dry and fully effective. Slack-filled bags are preferred for insulating an underground pipe this way.

Figure 7:
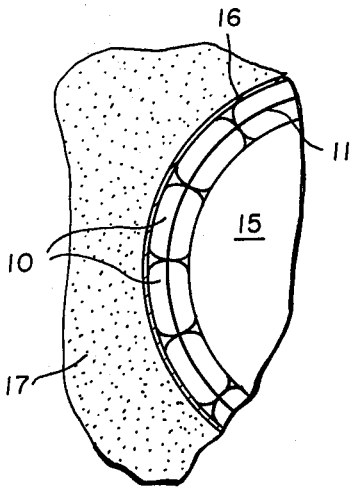
FIG. 7 is a fragmentary, schematic end view of an underground tank insulated according to my invention.

Another insulation problem suitable for bagged insulation particles is an insulated underground tank 15 such as shown in FIG. 7. Bags 10 can be arranged side by side along the axial length of cylindrical tank 15 as illustrated, and a protective wrapping sheet or tape 16 can be wound around bags 10 to hold them in place and maintain tight junctions between adjacent bags. Tanks of many different shapes and materials can be insulated this way; and when the tanks are buried underground, the earth 17 that is backfilled gently against bags 10 applies uniform pressure to hold the bags in place and keep the insulation particles from shifting within the bags. Underground walls and other structures can also be insulated this way.

Figure 5:
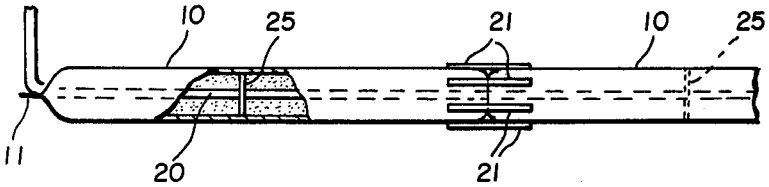
FIG. 5 is a partially cut away side elevational view of insulation bags arranged to surround a pipe.

Another alternative for insulating pipes with bags 10 is to fill the bags completely so they form long cylinders sealed at each end as shown in FIG. 5, and arrange them concentrically over a pipe 20 that can be either buried or above ground. This requires small openings at the ends of bags 10 to receive pipe 20 which can be threaded through a succession of bags 10 placed end to end in longitudinal abutment along the length of the pipe. Bag ends can be secured with adhesive tape 21 or other wrapping, and the bags can have a diameter suitable for disposing a thermal barrier layer of insulation particles of the right thickness around pipe 20.

Figure 6:
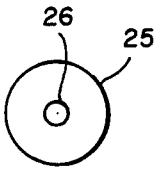
FIG. 6 is a plan view of a spacer used in the bags of FIG. 5.

One way to insure that bags 10 remain concentric to pipe 20 is to use periodic centering spacers 25 with central holes 26 as shown in FIG. 6. These can be arranged within bags 10 so that pipe 20 passes through holes 26 and spacers 25 keep bags 10 and their insulation material concentric with pipe 20.

I claim:

1. A thermal insulation system comprising:

a. a plurality of tough, generally tubular, resin bags;

b. loose, particulate insulation material packaged in each of said bags;

c. ends of said bags being sealed closed to contain said insulation material;

d. said bags being placed around a body to be insulated;

e. said insulation material being arranged in an even thermal barrier within said bags where it is contained and protected during use; and f. said bags being formed as elongated tubes sealed at both ends and substantially filled with said insulation material, said body being a pipe, and said bags being arranged end to end to said pipe extends axially through the insides of said bags.

2. The system of claim 1 including spacers arranged inside said bags to hold said bags concentrically on said pipe.

* * * * *